United States Patent [19]

Tabor

[11] Patent Number: 4,896,079

[45] Date of Patent: Jan. 23, 1990

[54] BI-LEVEL SWITCH

[75] Inventor: Jim Tabor, Dallas, Tex.

[73] Assignee: Prescolite, Inc., San Leandro, Calif.

[21] Appl. No.: 197,027

[22] Filed: May 20, 1988

[51] Int. Cl.[4] ..... H05B 37/00

[52] U.S. Cl. ..... 315/313; 315/324

[58] Field of Search ..... 315/312, 313, 314, 315, 315/320, 324

[56] References Cited

U.S. PATENT DOCUMENTS

| | | | |
|---|---|---|---|
| 4,350,935 | 9/1982 | Spira et al. | 315/291 |
| 4,390,814 | 6/1983 | Peek | 315/315 X |
| 4,488,092 | 12/1984 | Chikuma | 315/324 |
| 4,523,130 | 6/1985 | Pitel | 315/291 |

FOREIGN PATENT DOCUMENTS 118433 of 1977 Japan .
138148 of 1979 Japan .

*Primary Examiner*—David Mis
*Attorney, Agent, or Firm*—Bielen & Peterson

[57] ABSTRACT

A control mechanism for use with a fluorescent lighting unit having at least first and second lamps utilizing a line switch. The mechanism includes an AC toggle which alternately interrupts and connects electrical power from a source to one of the first and second lamps, only. The toggle is responsive to the successive opening and closing of the line switch. A reset feature overrides the means for alternately interrupting and connecting power source to one of the pair of lamps by connecting power from the source to the second lamp. The reset feature is also responsive to the operation of the line switch.

12 Claims, 3 Drawing Sheets

BI-LEVEL SWITCH

BACKGROUND OF THE INVENTION

The present invention relates to a novel control mechanism for switching off a lamp of a fluorescent lighting fixture having a plurality of lamps.

The dimming of fluorescent lamp has been proposed to conserve energy. Typically, a fluorescent fixture includes a ballast which provides an impedance to limit the current to a fluorescent lamp. Standard iron core ballast ar most commonly found in existing fluorescent fixtures. Replacement of a standard ballast with a dimming ballast would permit dimming of the fluorescent fixtures, but this requires a very expensive retrofit procedure.

U.S. Pat. No. 4,350,935, proposes the use of a circuit for dimming a fluorescent fixture with conventional ballasts. Unfortunately, the system proposed therein is quite expensive and necessitates complex wiring procedures. U.S. Pat. No. 4,523,130 also proposes a method of retrofitting a fluorescent fixture to provide a dimming of the same which requires a thorough reworking of the fixture.

U.S. Pat. No. 4,488,092 and Japanese patent application No. 50-1184443 describe illumination circuits which turn off one lamp of a pair of fluorescent fixtures using a pair of switches. Japanese patent application No. 52-138148 shows a pair of lamps which are alternately controlled by a relay in conjunction with SCR triggered by a capacitor.

None of the prior art references address the problem of controlling the operation of a pair of fluorescent lamps in order to illuminate the same one at a time or together by the operation of an existing line switch.

Overcoming the problems found in the prior art would be a great advance in the lighting industry.

SUMMARY OF THE INVENTION

In accordance with the present invention a control mechanism for use with a fluorescent lighting unit to alternatively or conjunctively power a power a pair of lamps is provided.

The control mechanism of the present invention may be employed with a fluorescent unit having at least first and second lamps. A line switch exits and regulates electrical power from a source to the first and second lamps. The invention includes means for alternatively interrupting and connecting electrical power from the source to one of the first and second lamps only. In other words, line switch may operate both lamps ON and OFF at the same time, or operate one of the lamps ON and OFF while the other lamp remains in the OFF position. Such means may be termed an "AC toggle". The "AC toggle" would be responsive to a momentary" opening of the line switch. Of course, the control mechanism of the present invention may be employed with a plurality of fluorescent lighting units each having at least first and second lamps. In certain cases, each lighting unit may have as many as four lamps and the AC toggle may be used to switch any number of lamps in the fluorescent unit.

The AC toggle may include a semiconductor placed between the source and the one fluorescent lamp. The gate of the semiconductor may be connected to a flip-flop circuit which is responsive to the opening of the line switch. In certain cases, a first JK flip-flop may be employed as a monostable multivibrator while a second JK flip-flop functions as a toggle. The monostable multivibrator may be employed to drive the clock input of the toggle flip-flop.

The present invention may also include means for overriding the interrupting and connecting means, a reset device. Such reset device would be responsive to an extended opening of the line switch. The extended time period of the "extended opening" heretofore described, would, be longer than the time period of the momentary opening employed to simply toggle one of the lamps of the fluorescent fixture. Both time periods may be adjusted by choosing the values for components for the AC toggle. The reset means for alternately interrupting and connecting electrical power from the source to the second lamp to determine its synchronization with the line switch, may include a power semiconductor placed between the source and one of the lamps of the fluorescent lighting fixture. The power semiconductor may be gated by first and second JK flip-flops acting in concert. The first JK flip-flop serves as a monostable multivibrator while the second JK flip-flop serves as a toggle flip-flop. The first JK flip-flop is interconnected to drive the clock input to the second JK flip-flop. Comparitor means is also employed to provide the clock input to the first JK flip-flop. The comparitor means is responsive to the openings of the line switch for a first period of time, a "momentary" opening. Likewise, the reset means for the second lamp of the particular fluorescent fixture has a comparitor which provides a reset input to the second JK flip-flop. The reset comparitor means is responsive to the opening of the line switch for a second period of time, an "extended" opening.

The control mechanism of the present invention may be placed across the line feed to the second lamp of the fluorescent fixture and, be physically installed within the fixture. Such installation merely requires the control device of the present mechanism to be wired in series with the power lead wire to the fluorescent fixture, a relatively simply task.

It may be apparent that a novel and useful control mechanism for use with a fluorescent lighting unit has been described.

It is therefore an object of the present invention to provide a control mechanism for a fluorescent lighting unit which includes a solid state switch whose output state may be controlled by the period of opening of the existing line switch.

It is another object of the present invention to provide control mechanism for use with a fluorescent lighting unit which is simple and inexpensive to install within the lighting unit without installing new mechanical switches or pulling wires from the existing line switch box to the fluorescent lighting unit.

Yet another object of the present invention is to provide a control mechanism for use with a fluorescent lighting unit which includes an AC toggle that may be reset by the period of opening of the existing line switch.

A further object of the present invention is to provide a control mechanism for use with fluorescent lighting which may be employed with a plurality of fluorescent lighting units having a plurality of lamps, and which possesses a reset mechanism to maintain the synchronization of the "ON-OFF" state of particular lamps in each of the fluorescent lighting units.

Another object of the present invention is to provide a control mechanism for use with a fluorescent lighting unit that obviates the need for a fluorescent dimmer in order to conserve energy.

Yet another object of the present invention is to provide a control mechanism for use with a fluorescent lighting unit which controls the light output from the fluorescent lighting unit without substitution of an existing standard ballast.

The invention possesses other objects and advantages especially as concerns particular characteristic and features thereof which will become apparent as the specification continues.

Figure 1:
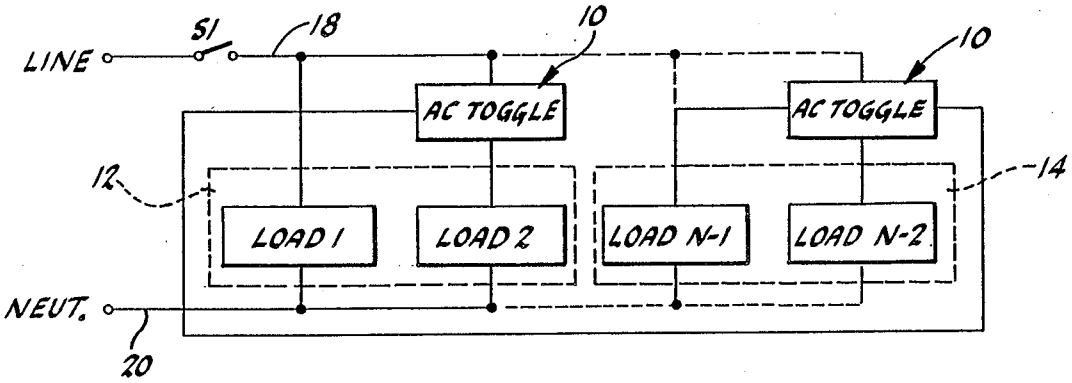
FIG. 1 is a schematic depicting the use of the present invention with a plurality of fluorescent lighting units.
Figure 2:
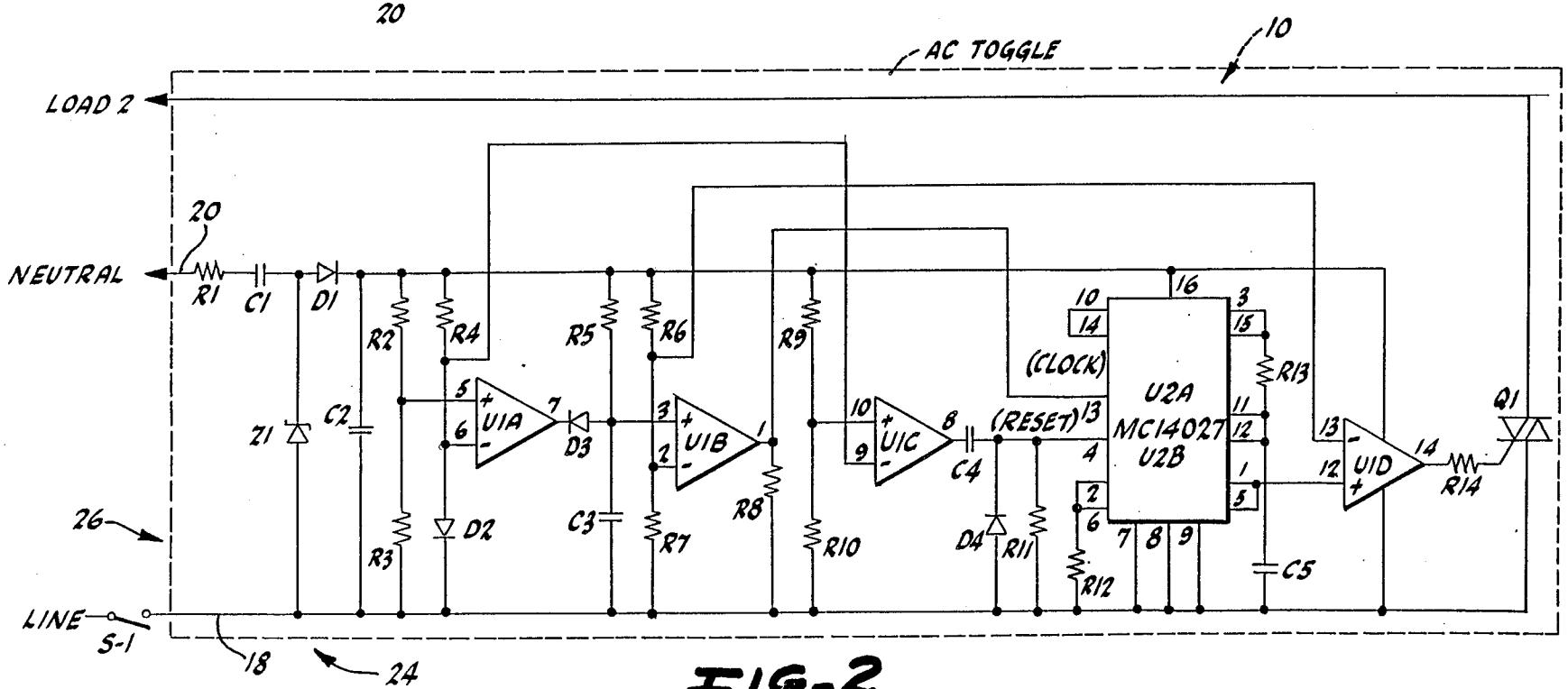
FIG. 2 is a schematic of the circuitry of the AC toggle portion depicted in FIG. 1 with respect to LOAD Z of Fluorescent Lighting Unit 12.

FIGS. *3a–h*, *4a–h* and *5a–h* are a series of graphs depicting the voltage level of various components of the schematic depicted in FIG. 2, at various times relative to the operation of LINE switch S1.

For a better understanding of the invention reference is made to the following detailed description of the preferred embodiments thereof which should be referenced to the hereinabove drawings.

DESCRIPTION OF THE PREFERRED EMBODIMENTS

Various aspects of the present invention will evolve from the following detailed description of the preferred embodiments which should be taken in conjunction with the hereinabove drawings.

The invention as a whole is depicted in the drawings by reference character 10. A pair of AC toggles 10 are depicted as being used in conjunction with fluorescent lighting units 12 and 14. However, AC toggle 10 may be similarly employed with other fluorescent lighting units operated by line switch S-1 (not shown) a line switch S-1 which interrupts the line leg 18 from power source 16. Line switch S1 may take the form of a conventional single pole, double throw mechanical switch. It should be noted that fluorescent lighting unit 12 includes loads 1 and 2, each of which may be a typical fluorescent lamp. Likewise, fluorescent unit 14 includes loads N-1 and N-2. However, each fluorescent lighting unit 12 or 14 may include a single lamp or more than two lamps. A pair of AC toggles 10, the structure of which will be discussed in detail hereafter intercepts load 2 and load N-2 of fluorescent lighting units 12 and 14, respectively. Neutral leg 20 feeds the lamps of fluorescent units 12 and 14, as well as the pair of AC toggles 10.

Each AC toggle 10 essentially comprises a solid state switch whose output state (ON or OFF), is controlled by the period of time line switch S-1 is open. AC toggle 10 depicted in FIG. 2 is intended to control LOAD 2 of fluorescent lighting unit 12. In general, the circuit depicted in FIG. 2 depicts dual JK flip-flops U2A and U2B, as well as operational amplifiers (op-amps) U1A, U1B, U1C, and U1D. A power semiconductor Q1 controls the ON-OFF state between the LOAD 2 and LINE leg 18. Gate lead 22 to power semiconductor Q1 derives from the output pin 14 of U1D through resistor R14. For the sake of clarity, pins in the circuit depicted in FIG. 2 will follow the component preceded by a hyphen, hereinafter. When the output of pin U2B-1/5 is high, pin U1D-14 is high and the gate drive 22 activates triac Q1. With triac Q1 ON, load 2 is connected to LINE leg 18. Consequently, if LOAD 2 is a lamp, it is lit. JK flip-flops U2A and U2B serve as a single shot multivibrator and a toggle flip-flop, respectively. In general the single shot JK flip-flop U2A drives the clock of the toggle flip-flop U2B. Pins 10, 11, 12, 13, 14 and 15 are associated with JK flip-flop U2A. Pins 2, 3, 4, 6, 1/5 and 7 are associated with JK flip-flop U2B. Pins 8 and 16 are common pins of the LINE and NEUTRAL sides of the dual flip-flops U2A and U2B. Since JK flip-flop U2B is connected in the "toggle" mode, a signal into clock input pin U2B-3 causes a change of state. For example, if pin U2B-1/5 is high then clock signal into pin U2B-3 causes the output pin U2B-1/5 to go "low". A succeeding clock pulse at U2B-3 will cause pin U2B-1/5 to g "high". In other words U2B "toggles". U2B also receives an input at reset pin U2B-4. A RESET signal causes the output of U2B-1/5 to go "low", regardless of the state of flip-flop U2B i.e. "high" or "low. The RESET signal is necessary if fluorescent lighting units 12 and 14 fall out of sychronization from disturbances on LINE 18 or otherwise.

U2A functions as a single shot or monostable multivibrator. As connected in FIG. 2, it has only one stable state i.e. when pin U2A-15 is "low". Otherwise flip-flop U2A is connected similarly to flip-flop U2B. A clock pulse into pin U2A-13 causes its output pin U2A-15 to go "high". At this point, a clock pulse applied to pin U2B-3 causes the previously discussed pin U2B-1/5 to go "low". When pin U2A-15 goes "high", C5 is charged through R13. When the voltage on C5 reaches some threshold value, pin U1D-12 is activated. Pin U1D-12 also serves as the RESET for the U2A flip-flop. Thus, pin U2A-15 stays high for time determined by the R13/C5 time constant. Although op-amp U1D is connected as a comparitor, its purpose is to amplify the output of U2B into the gate lead 22 of triac Q1.

Op-amp U1C generates RESET pulses for U2B. Again, U1C is connected as a comparitor. When the voltage on pin U1C-10 exceeds that of pin U1C-9 output pin U1C-8 goes "high". This generates pulse on R11 as capacitor C4 is charged. The duration of this pulse is determined by the R11/C4 time constant. When the voltage on pin UC1-10 is less than U1C-9, the output of U1C-8 goes "low" and C4 is discharged through diode D4. C4 is then ready for the generation for the next RESET pulse.

Op-Amp U1B serves as a comparitor, also. When the voltage on U1B-3 exceeds that of U1-2, U1B-1 goes "high". This rising signal across R8 is connected to pin U2A-13, the CLOCK input of U2A input. The previously discussed one-shot pulse is generated by this CLOCK input. Charging capacitor C3 through resistor R5 provides the voltage on pin U1B-3. It should be noted, capacitor C3 cannot charge if the output U1A-7 is "low" therefore U1A controls the generation of a CLOCK pulse from U1B.

The output of Op-Amp U1A goes high when pin U1A-5 exceeds pin U1A-6. C3 is now able to charge R5. When pin U1A-5 is lesser than pin U1A-6, U1A-7 goes "low" and C3 is discharged through diode D3.

Components R1, C1, Z1, D1 and C2 provide the DC supply through AC toggle 10. Assuming the neutral leg 20 is positive with respect to line leg 18, the current follows two paths. The first path travels through R1, C1, and Z1. The second path travels through R1, C1, D1, and C2. Zener Z1 clips the voltage (typically 15 volts) and capacitor C2 will try to charge to this value during a half-cycle of the current through LINE leg 18. When LINE leg 18 becomes positive with respect to the neutral leg 20, current flows through Z1, C1 and R1. Capacitor C2 cannot discharge through D1. Therefore, C2 is charged at every half cycle at line voltage from the NEUTRAL-LINE current flow.

Figure 3:
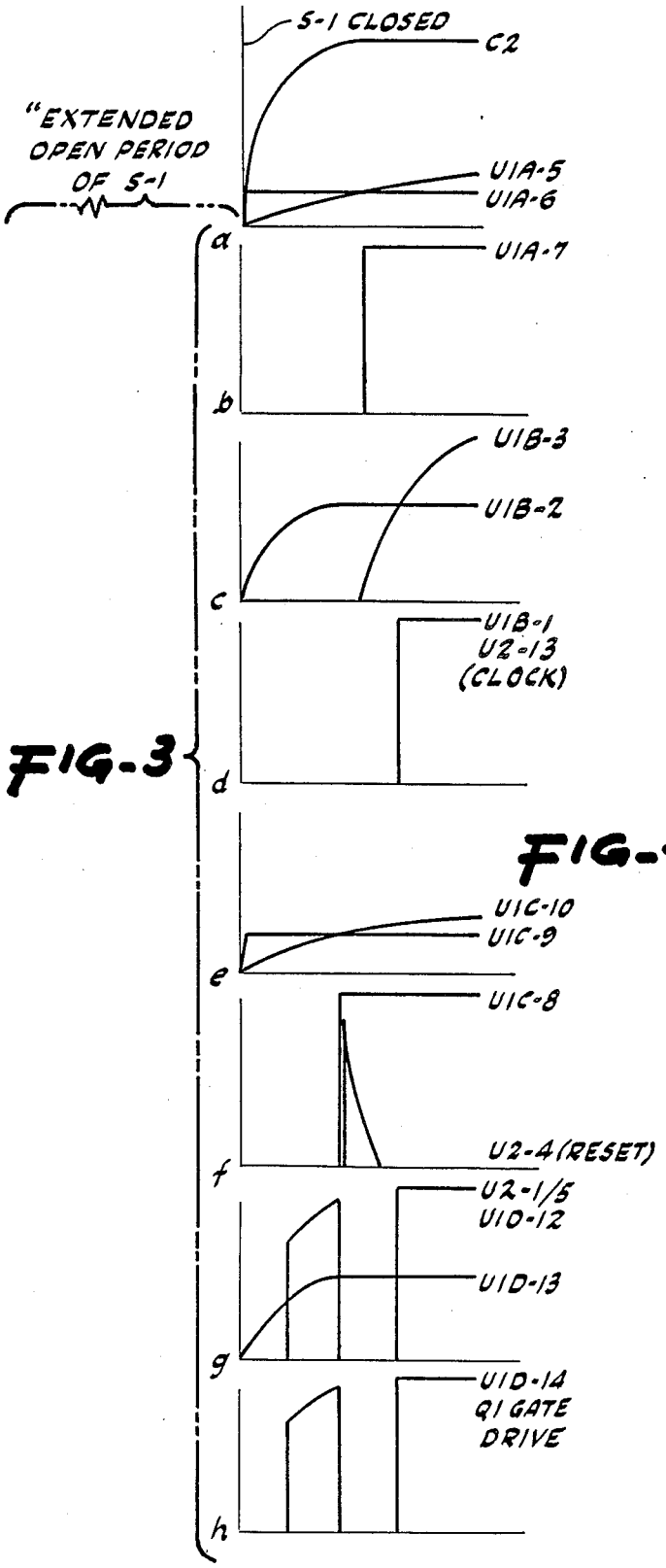

In operation, the circuit of FIG. 2 causes the time-voltage relationship shown in FIGS. 3–5, as will be described hereinafter. When line switch S-1 is closed, capacitor C2 begins to charge in the circuit and components in the AC toggle 10 follow the relationships depicted in FIG. 3a-*h*. When the voltage on C2 reaches approximately 2 volts, diode D2 will develop a voltage of about 0.5–0.6 volts. This D2 voltage will bias U1A to the "OFF" state (pin U1A-7 is "low"). Also, U1C will be biased in the "OFF" state (pin U1C-8 is "low"). When pin U1A-7 is low, C3 cannot charge and pin U1B-1 will be "low", as a result of the voltage divider R6/R7 which biases U1B "OFF" (FIG. 3*c*). As C2 continues to charge, the voltage developed by divider R9/R1O will exceed the voltage on pin U1C-9 (FIG. 3*e*). Pin U1C-8 then goes "high" (FIG. 3*f*) and a pulse is generated on R11 which passes into RESET pin U2B-4. At this point pin U2B-1/5 is RESET to zero, regardless of its previous state.

As C2 continues to charge pin U1A-5 will exceed pin U1A-6 (FIG. 3*a*). Pin U1A-7 goes high (FIG. 3*b*) and diode D3 is back biased. Capacitor C3 now can begin to charge through resistor R5 (FIG. 3*c*). When pin U1B-3 exceeds pin U1B-2, pin U1B-1 goes "high" across R8 and signals CLOCK pin U2A-13. As previously noted, a pulse is subsequently generated by flip-flop U2A which clocks, or toggles, flip-flop U2B to produce a high output at pin U2B-1/5 (FIG. 3*g*). At this point pin U1D-12 exceeds U1D-13 such that pin U1D-14 goes "high" and provides the gate drive to Q1 (FIG. 3*h*). Again, Q1 turns ON and connects LINE leg 18 to LOAD 2. In general FIG. 3 describes the sequence of engerization of the circuit depicted in FIG. 2. As long as the circuit is ON and C2 is fully charged, the output pin U2B-1/5 stays "high" and the output of pin U1D-14 is "high", gating triac Q1 ON, continuously.

Figure 4:
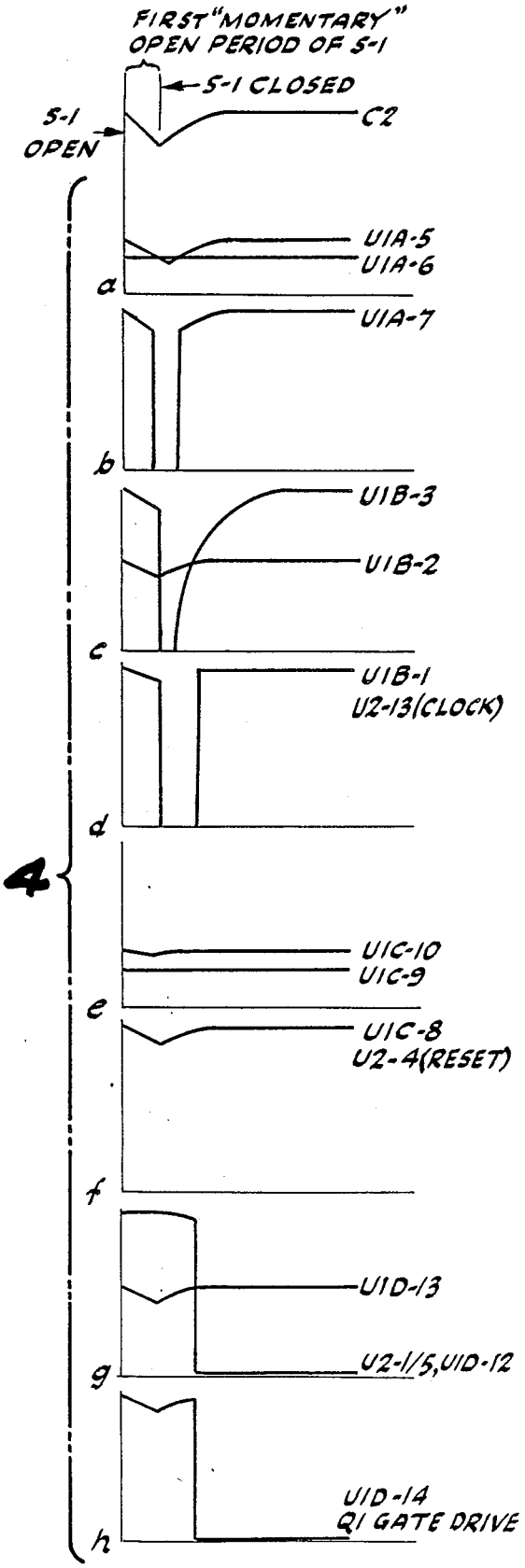
Figure 5:
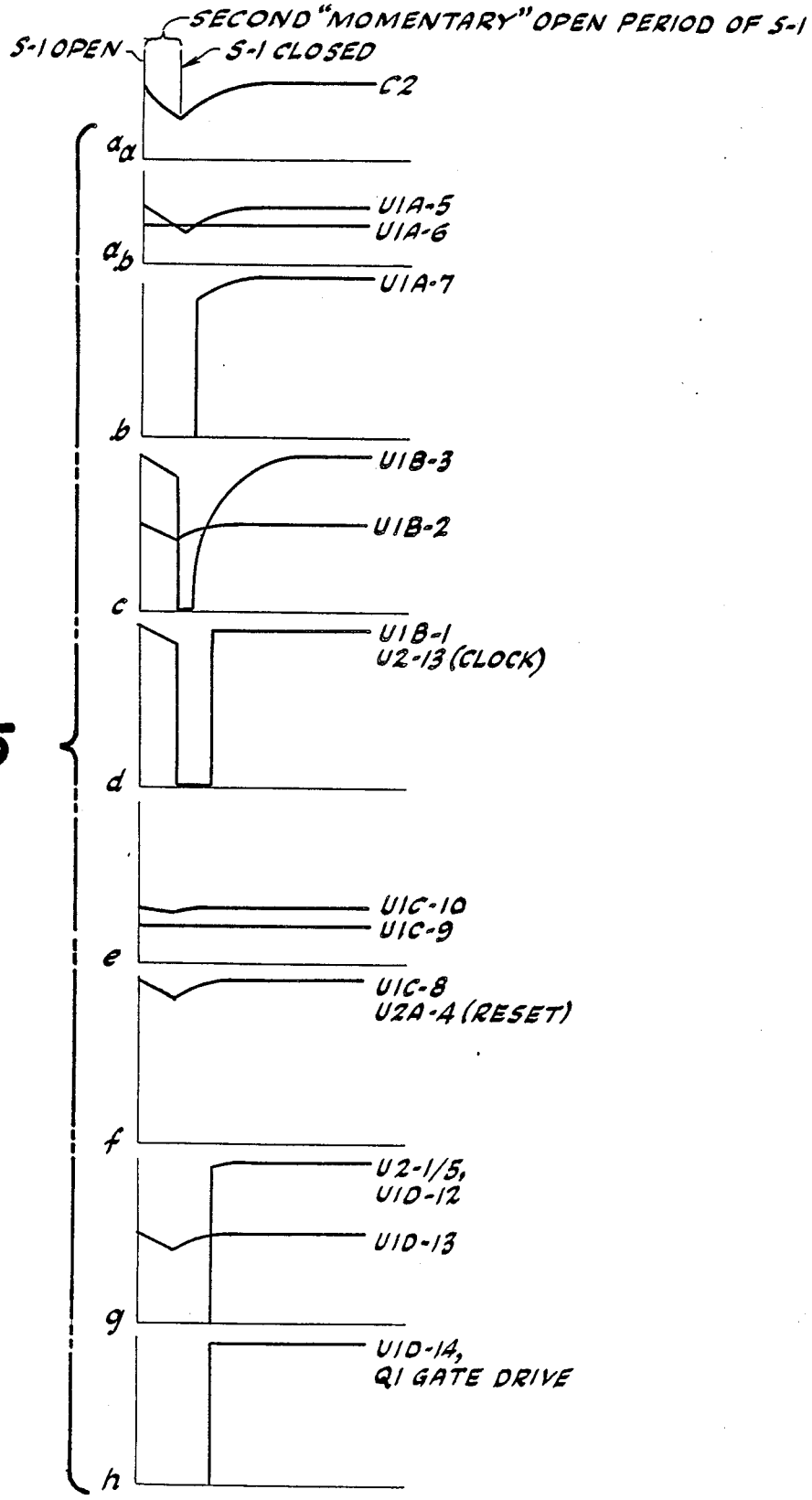

With reference to FIG. 4, when line switch S-1 is open "momentarily" e.g. about one second. This momentary opening will cause C2 to discharge (FIG. 4*a*). Pin U1A-5 will dip below pin U1A-6 causing pin U1A-6 to go "low" (FIG. 4*b*) discharging C3. Pin U1B-3 then dips below U1B-2 (FIG. 4*c*) and pin U1B-1 goes "low" (FIG. 4*d*). It should be apparent that pin U1C-10 decreases slightly, but still exceeds U1C-9, consequently, U1C-8 stays "high" with C4 fully charged. No RESET pulse is generated on R11 at this time. The closing of S-1 (noted at the top of FIG. 4) again begins the charging of C2 (FIG. 4*a*) and pin U1A-5 exceeds pins U1A-6 such that pin U1A-7 goes "high" (FIG. 4*b*). C3 can now charge. Subsequently, pin U1B-2 exceeds pin U1B-3, and the output pin U1B-1 goes "high" applying CLOCK signal to pin U2A-13. U2A again pulses the clock of U2B and pin U2B-1/5 goes "low" (FIG. 4*g*). The output U1D-14 goes "low" and the Q1 gate drive on gate lead 22 disappears. Triac Q1 turns OFF and the load 2 is disconnected from line leg 18. If load 2 is a lamp, the lamp remains OFF conserving energy while load 1 remains ON to provide the necessary lighting in a space holding fluorescent unit 12. A second "momentary" opening of switch S1 results in the wave form shown in FIGS. 5*a*–5*h*. At this time Q1 is turned ON. Successive momentary openings of switch S1 will toggle the circuit depicted in FIG. 2 and the alternate ON and OFF states of power semiconductor Q1.

When S1 is opened for an "extended" time (about 3 seconds) the wave form depicted in FIG. 3 will be repeated and always turn ON power semiconductor Q1, when LINE leg 18 is impressed on the circuit depicted in FIG. 2. Thus, the successive "momentary" openings of S1, between the closing of S-1, serve as means 24 for alternately interrupting and connecting electrical power from source 16 to load 2. In addition, the "extended" opening of switch S-1 as depicted in FIG. 3, serves as RESET means 26 which overrides means 24 to allow Q1 to always turn ON when LINE LEG 18 passes through the circuit of FIG. 2 upon the closing of switch S1.

A table depicting a typical values of a component shown in the circuit of FIG. 2 are as follows:

| COMPONENT | VALUE |
|---|---|
| R1 | 200 ohms, ½ w, 5% |
| R2, R6, R7, R8, R9, R11 | 1 Meg, ¼ w, 5% |
| R3 | 47 KOhms, ¼ w, 5% |
| R4, R10 | 100 KOhms,¼ w, 5% |
| R5 | 4.7 MegOhms, ¼ 4, 5% |
| R12, R14 | 1 KOhms, ¼ w, 5% |
| R13 | 10 Meg, ¼ w, 5% |
| Z1 | 15 Volt, 600 MW |
| D1, D2, D3, D4 | 1N4148 |
| C1 | 1.0 micro 1250 v |
| C2 | 1500 micro 150 v |
| C3, C4, C5 | 011 micro 1250 v |
| U1 | LM324N |
| U2 | MC14027 |
| Q1 | 8A1200 v |

While in the foregoing embodiments of the present invention have been set forth in considerable detail for the purposes of making complete disclosure of the invention, it may be apparent to those of skill in the art that numerous changes may be made in such detail without departing from the spirit and principles of the invention.

What is claimed is:

1. A control mechanism for use with one fluorescent lighting unit having at least first and second lamps and a line switch to regulate electrical power from a source to the first and second lamps, comprising:

a. means for alternately interrupting and connecting electrical power from the source to the second lamp, only, responsive to the successive opening and closing of the line switch; and b. reset means for overriding said means for alternately interrupting and connecting power from the source to the second lamp by connecting power from the source to the second lamp, responsive to the operation of the line switch.

2. The control mechanism of claim 1 which further comprises means for activating said means for alternately interrupting and connecting electrical power from the source to the second lamp of the one fluorescent fixture by retaining the line switch in an open position for one period of time.

3. The control mechanism of claim 2 which further comprises means for activating said reset means for said second lamp of said one fluorescent fixture by retaining the line switch in an open position for another period of time.

4. The control mechanism of claim 1 which is additionally used with a second fluorescent lighting unit having at least first and second lamps and said means for alternately interrupting and connecting power from the source to the second lamp only of the one fluorescent lighting unit further includes means for alternately interrupting and connecting power from the source to the second lamp of the second fluorescent lighting unit.

5. The control mechanism of claim 4 in which said reset means for overriding said means for alternately interrupting and connecting power from the source to the second lamp of the one fluorescent fixture further includes means for overriding said means for alternately interrupting and connecting electrical power from the source to the second lamp of the second fluorescent lighting unit, by connecting power from the source to the second lamp of the second fluorescent fixture, responsive to the operation of the line switch.

6. The control mechanism of claim 5 which further comprises means for activating said reset means for said second lamps of said one and second fluorescent fixtures by retaining the line switch in an open position for said another period of time.

7. The control mechanism of claim 6 in which said one period of time is less than said another period of time 8. The control mechanism of claim 1 in which said means for alternately interrupting and connecting electrical power from the source to the second lamp only includes a power semiconductor placed between the source and the second lamp of the one fluorescent lighting fixture, the gate of said power semiconductor being connected to a first JK flip-flop, said first JK flip-flop serving as a monostable multivibrator, and a second JK flip-flop serving as toggle flip-flop, said first JK flip-flop interconnected to drive the clock input to said second JK flip-flop.

9. The control mechanism of claim 8 which further comprises comparitor means for providing a clock input to said first JK flip-flop, said comparitor means being responsive to the opening of the line switch for said one period of time.

10. The control mechanism of claim 9 in which said reset means for said second lamps of said one and second fluorescent fixtures includes comparitor means for providing a reset input to said second JK flip-flop, said comparitor means being responsive to the opening of the line switch for said another period of time.

11. The control mechanism of claim 6 which includes means for adjusting the duration of said one period of time.

12. The control mechanism of claim 6 which includes means for adjusting the duration of said another period of time.

* * * * *